US005584473A

United States Patent [19]

Baba

[11] Patent Number: 5,584,473

[45] Date of Patent: Dec. 17, 1996

[54] DOCUMENT FEEDING APPARATUS WITH EJECTING MEANS PARTLY ASSOCIATED WITH TRANSFERING MEANS

[75] Inventor: Kenji Baba, Kohfu, Japan

[73] Assignee: Nisca Corporation, Yamanashi-ken, Japan

[21] Appl. No.: 513,625

[22] Filed: Aug. 10, 1995

Related U.S. Application Data

[60] Division of Ser. No. 151,310, Nov. 12, 1993, Pat. No. 5,478,065, which is a continuation-in-part of Ser. No. 141, 973, Oct. 28, 1993, abandoned.

[51] Int. Cl.[6] ..... B65H 5/22

[52] U.S. Cl. ..... 271/3.18; 271/3.2; 271/3.21; 271/4.04

[58] Field of Search ..... 271/3.18, 3.21, 271/3.2, 4.01, 4.04, 7, 3.14, 69, 176, 3.01, 198, 314

[56] References Cited

U.S. PATENT DOCUMENTS

| | | | |
|---|---|---|---|
| 5,033,728 | 7/1991 | Miura et al. | 271/3.18 |
| 5,116,042 | 5/1992 | Hamanaka | 271/176 |
| 5,120,039 | 6/1992 | Yamada | 271/6 X |
| 5,197,723 | 3/1993 | Yamada et al. | 271/6 X |

FOREIGN PATENT DOCUMENTS

| | | |
|---|---|---|
| 60-140364 | 7/1985 | Japan . |
| 61-32836 | 2/1986 | Japan . |
| 62-169142 | 7/1987 | Japan . |
| 1-236136 | 9/1989 | Japan . |
| 1-236137 | 9/1989 | Japan . |

*Primary Examiner*—David H. Bollinger
*Attorney, Agent, or Firm*—Kanesaka & Takeuchi

[57] ABSTRACT

A transferring device for feeding a document to a predetermined position and further transferring the document from the predetermined position and an ejecting device for ejecting the transferred document are formed in a simple structure to have the same transfer speeds, so that the document is prevented from being damaged and, further, the ejecting speed can be controlled at will.

5 Claims, 17 Drawing Sheets

DOCUMENT FEEDING APPARATUS WITH EJECTING MEANS PARTLY ASSOCIATED WITH TRANSFERING MEANS

CROSS REFERENCE TO RELATED APPLICATION

The present application is a divisional application of patent application Ser. No. 08/151,310, filed on Nov. 12, 1993, now U.S. Pat. No. 5,478,065, which is a continuation-in-part of application Ser. No. 141,973, filed on Oct. 28, 1993 abandoned.

BACKGROUND OF THE INVENTION AND RELATED ART STATEMENT

The present invention relates to a document feeding apparatus comprising transferring means for feeding a document to a predetermined position to set thereat and transferring the document from the predetermined position, and ejecting means for receiving the transferred document and ejecting to an ejecting tray.

In a conventional document feeding apparatus comprising transferring means for feeding and setting a document at a predetermined position on a platen of an image processing apparatus (hereinafter referred to as a main device) such as a copying machine and for transferring the document from the predetermined position after the necessary processing is completed, and ejecting means for receiving the transferred document and ejecting to an ejecting tray, driving means for driving the transferring means and driving means for driving the ejecting means have been provided separately. (Japanese Patent Laid-open Publication No. Sho 62-169142)

As described above, with provision of the separate driving means for the transferring means and the ejecting means, the transferring means and the ejecting means can operate separately. Thus, it has advantages, for example, such that documents can be ejected at a speed faster than a linear velocity of the transferring means; or an ejecting operation of the document can be continuously carried out even in case the transferring means is to be stopped in the mid-way of transfer of the document, as in a document feeding apparatus wherein a transferring operation of a first document and a setting operation of a second document at a predetermined position are performed at the same time, that is, a step feeding. (Japanese Patent Laid-open Publication No. Hei 1-236136 or Hei 1-236137)

However, the transferring means and the ejecting means have separate driving means and operate independently, but in a section where the document is transferred to the ejecting means from the transferring means and receives feeding forces from both the means, the feeding linear velocities of both the means must completely coincide with each other. Because, if, for example, a linear velocity at the side of the transferring means is faster than that at the side of the ejecting means, the document to be ejected is bent since the latter half of the document is fed faster than the first half to thereby be damaged, i.e., wrinkled. Therefore, it has been a problem that many steps are required to make the linear velocities of the driving means for both the means coincide with each other.

Further, when the linear velocity at the side of the ejecting means is a little faster, there is no risk of the damage as mentioned above, but driving means with a large output is required.

Also, in case a document is drawn out under the stopped feeding means, there has been a problem such that driving means with a power greater than that required for simply ejecting the document is necessary.

The present invention has been developed based on the problems of the conventional apparatus, and it is an object of the present invention to provide a document feeding apparatus wherein driving means for transferring means and ejecting means are provided separately, an ejecting operation can be carried out at will and quickly regardless of a feeding linear velocity at the side of the transferring means, and further a large power for driving the ejecting means is not required.

The present invention comprises transferring means; ejecting means for ejecting a document to a paper ejecting tray; first driving means drivingly connected to the transferring and ejecting means to drive the same at a first speed; second driving means drivingly connected to the ejecting means to drive the same at a second speed; connecting means for preventing the driving force of the second driving means from being transmitted to the transferring means as well as allowing the driving force of the first driving means to be transmitted to the ejecting means; and control means for controlling such that after the first driving means is driven to feed the document from the transferring means to the ejecting means, the first driving means is stopped, and the document is ejected to the paper ejecting tray by the second driving means.

DETAILED DESCRIPTION OF PREFERRED EMBODIMENTS OF THE INVENTION

Hereinunder, referring to drawings, embodiments of the present invention are described.

First, a construction thereof is described.

Figure 1:
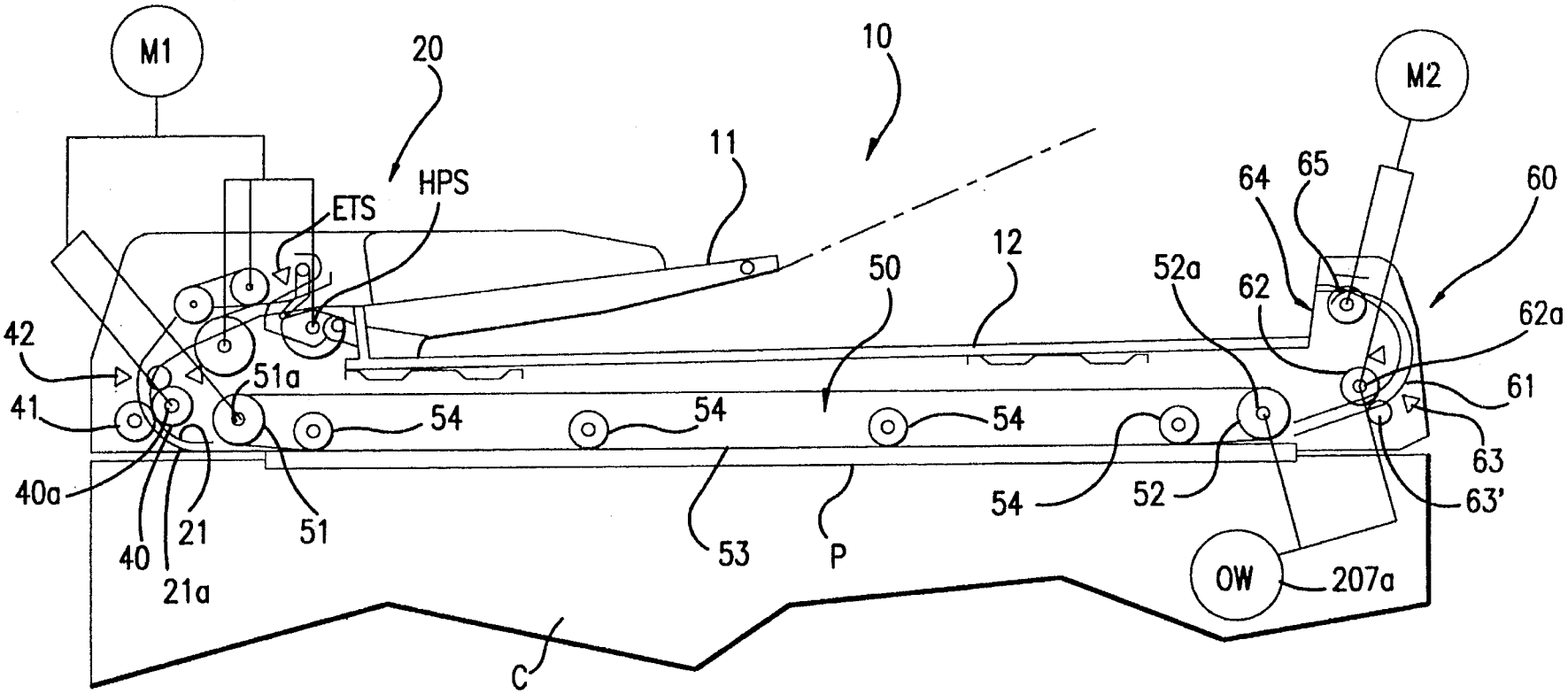
FIG. 1 is a vertical side section view of a document feeding apparatus.

A document feeding apparatus 10, as shown in FIG. 1, comprises a document tray 11 on which documents are placed, a paper feeding portion 20 for separating documents on the document tray 11 and feeding them one by one, transferring means such as transferring portion 50 for receiving the document from the paper feeding portion 20 and transferring the document to a predetermined position on a platen P of a main device C so that the document is subjected to a light exposure processing, ejecting means such as an ejecting portion 60 for ejecting the exposed document, an ejected paper tray 12 for accumulating the ejected documents thereon, and controlling means such as a controlling device, not shown.

The present document feeding apparatus 10, as shown in FIG. 1, is structured such that documents on the document tray 11 in the drawing are fed to the left-hand side and ejected onto the ejected paper tray 12 disposed under the document tray 11 through one circulation, so that the spacious document tray 11 and ejected paper tray 12 do not project outwardly from the device 10 to thereby contribute to reducing a space for installing the main device C, that is, the present document feeding apparatus being formed with a reduced installation space.

Thus, the paper feeding portion 20, the transferring portion 50 and the ejecting portion 60 are arranged to be driven by a first driving motor M1 as the first driving means, and the ejecting portion 60 is arranged to be separately driven by a second driving motor M2 as the second driving means, but the detailed structure is described later.

Next, the construction of the paper feeding portion 20 is described in detail with reference to FIGS. 2 and 3.

In the paper feeding portion 20, a guide plate 21 extending from an edge portion in a downstream side of the document tray 11 to an entrance of the transferring portion 50 to guide a document is provided.

Sending-out means such as a semicircular roller 23 rotated by a shaft 22 is provided at the lower part in the uppermost stream side of the guide plate 21. The semicircular roller 23 contacts the lowest document of documents stacked on the document tray 11 to transfer the same, and a notched side 23*a* thereof faces upwardly when it is in the home position (HPS) and is hidden under the guide plate 21.

Stopper means such as a stopper 25 is provided, which is supported at an arm portion 25*b* by a shaft 24, and passes through the guide plate 21 so as to freely move in and out through the semicircular roller 23. This stopper 25 has a claw portion 25*a* passing through the guide plate 21 and restricting the leading edge of the document. Further, the arm portion 25*b* is integrally coupled with a lever 28.

And, the lever 28 is coupled with a plunger 26*a* of a second solenoid (SOL2) 26 through a pin 27 and a coupling lever 27. Further, the lever 28 is urged upward by a spring 29, the urging force, when SOL2 is not energized, rotates the lever 28 in the clockwise direction in FIG. 2, and in association with the rotation, the stopper 25 also rotates in the clockwise direction, while the claw portion 25*a* projects through the guide plate 21 and is in a state for restricting the leading edge of the document.

In the downstream side along the guide plate 21, a feeding roller 30 rotating together with a shaft 30*a* and feeding a document is provided.

Further, above the feeding roller 30, provided is separating means 31 comprising a pair of rollers 32, 33 and a separating belt 34 extended around the pair of rollers 32, 33. The rollers 32, 33 are fixed to shafts 32*a*, 33*a*, respectively, and the shaft 32*a* is a driving shaft which is rotated in the counterclockwise direction in FIG. 2, and operates to push back all documents except the lowermost document to the upstream side.

Document pressing means 35 for contacting the uppermost document and pressing documents from the upper side is swingably pivoted by the shaft 32*a*. The document pressing means 35 comprises a pressing plate portion 35*a* contacting the documents and a weight portion 35*b* providing a pressing force to the documents by its own weight. A first solenoid (SOL1) 36 for providing a force larger than the weight of the document pressing means 35 is provided. The weight portion 35*b* and a plunger 36*a* of the SOL1 are coupled by pins 36*b* and 38 respectively through a coupling lever 37.

Figure 2:
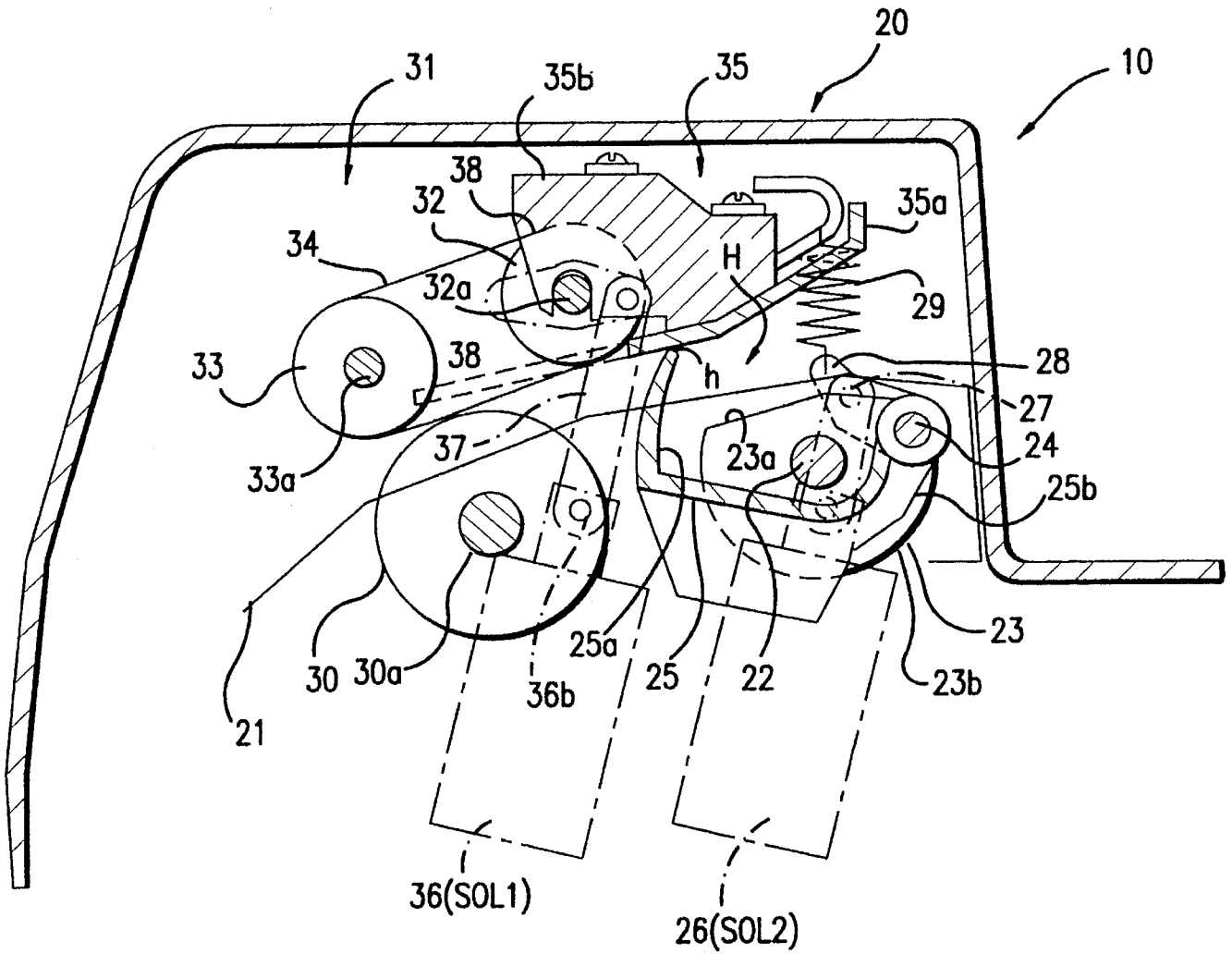
FIG. 2 is a vertical side section view of a paper feeding portion.
Figure 3:
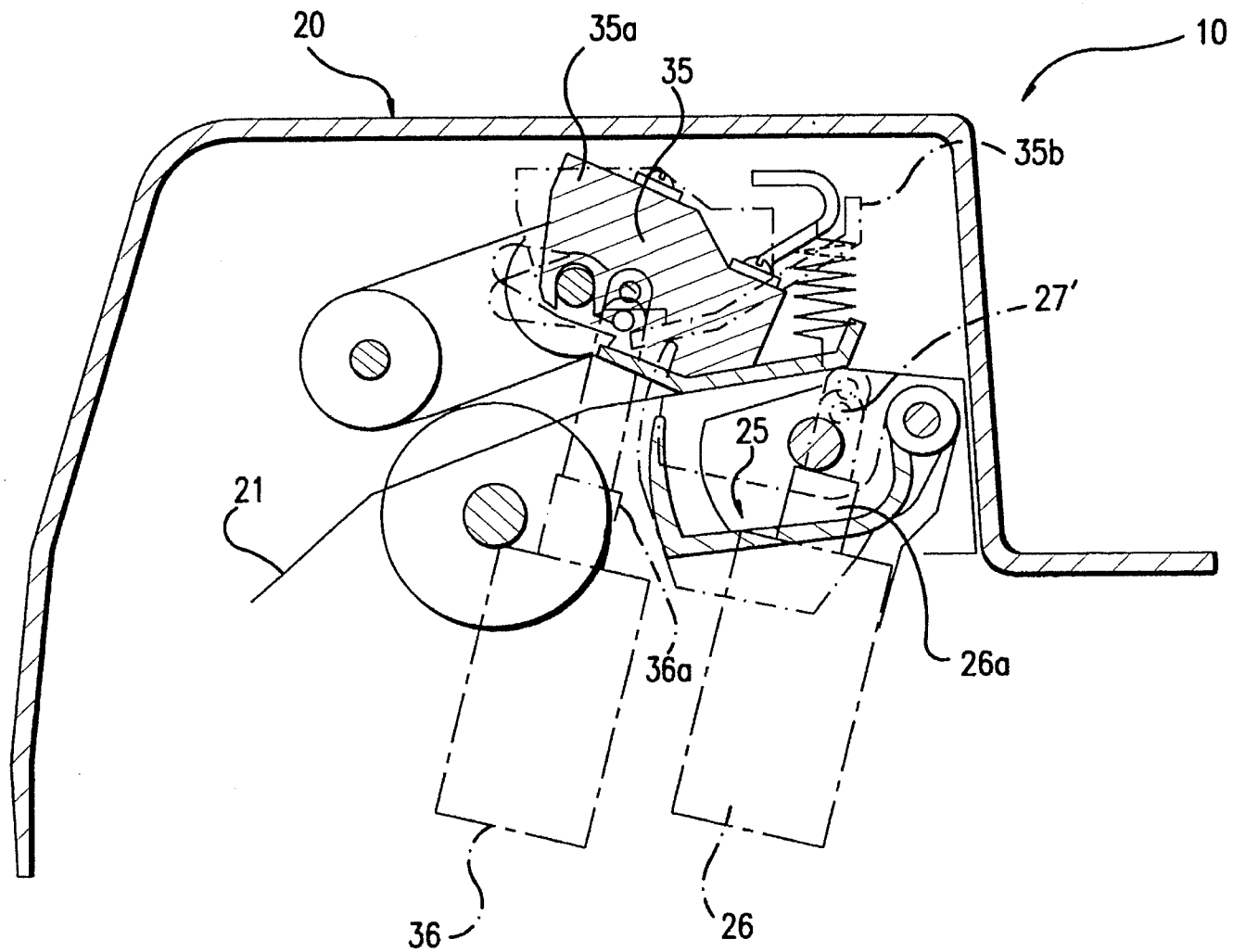
FIG. 3 is an explanatory view of an operation of the paper feeding portion.

However, as shown in FIGS. 2 and 3, when the solenoids SOL1 and SOL2 are not magnetized, the claw portion 25*a* of the stopper 25 is projected upward by the spring 29 fixed to the lever 28, and a leading edge of the claw portion 25*a* engages the pressing plate portion 35*a* of the document pressing means 35 to push upward. Thus, as shown in FIG. 2, a document set space H is formed by an upper surface of the guide plate 21, a rear surface of the claw portion 25*a* and the lower surface of the pressing plate portion 35*a* of the document pressing means 35 so as not to allow the document to slip out. The document positioned in the document set space H does not slip out therefrom since the leading edge of the claw portion 25*a* strongly abuts against the lower surface of the pressing plate portion 35*a* at an abutting portion h. Incidentally, in the document set space, an empty sensor ETS for detecting presence of documents is provided.

When the solenoid SOL2 is actuated and the plunger 26*a* is drawn, the stopper 25 rotates in the counterclockwise direction in the drawing, the claw portion 25*a* is withdrawn from the surface of the guide plate 21, the document pressing means 35 is rotated in the clockwise direction by its own weight and the pressing plate portion 35*a* presses the upper surface of the document as shown in FIG. 3. Incidentally, the operation of this portion is described later.

The guide plate 21 further extends, bends, and guides a document in cooperation with an outer guide plate 21*a* to an entrance of the transferring portion 50 while reversing the document. Further, there are provided at the vicinity of the curved portion a register roller 40 and a register pinch roller 41 for catching a leading edge of the document and adjusting a posture of the document and a timing for feeding the document, and a register sensor 42 for detecting a feed timing of a paper to be fed.

Figure 4:
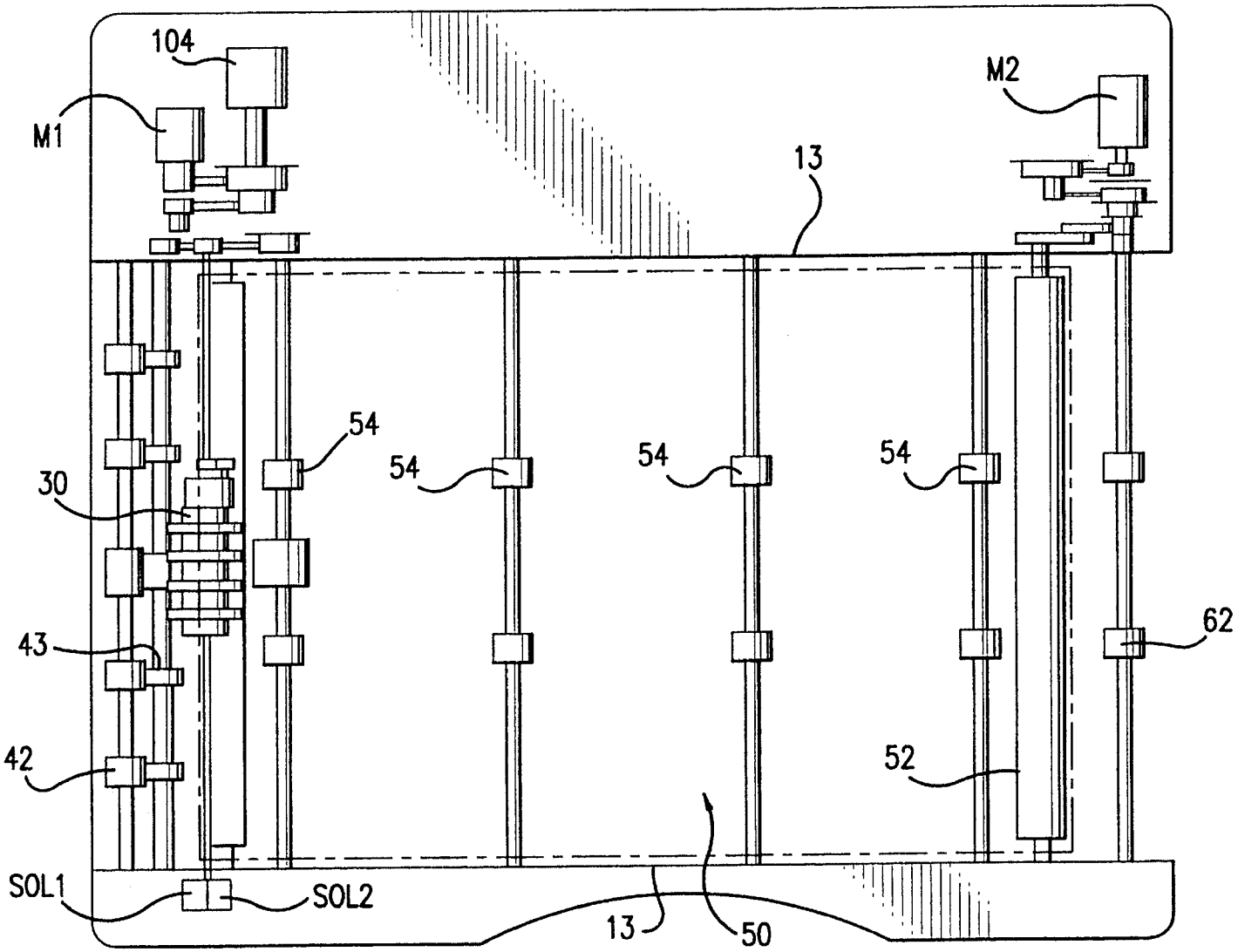
FIG. 4 is a partially omitted plan view of the document feeding apparatus.

The transferring portion 50, as shown in FIGS. 1 and 4, is formed such that side plates 13 of the document feeding apparatus 10 pivotally support a pair of belt rollers 51, 52, a feeding belt 53 is extended around the belt rollers 51, 52, and a plurality of press rollers 54 is provided thereon.

Figure 5:
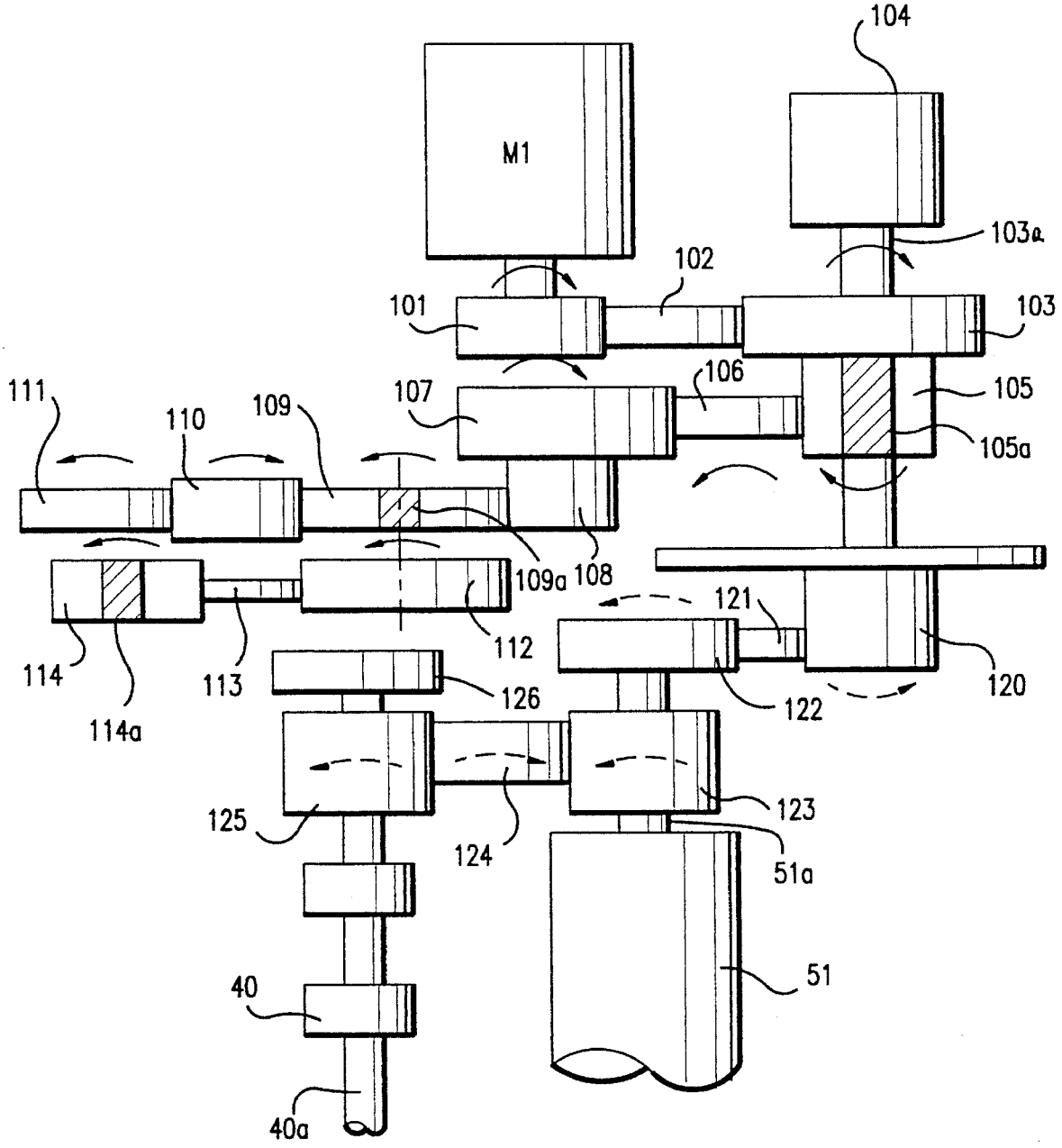
FIG. 5 is a flow chart for showing a driving system of first driving means.
Figure 6:
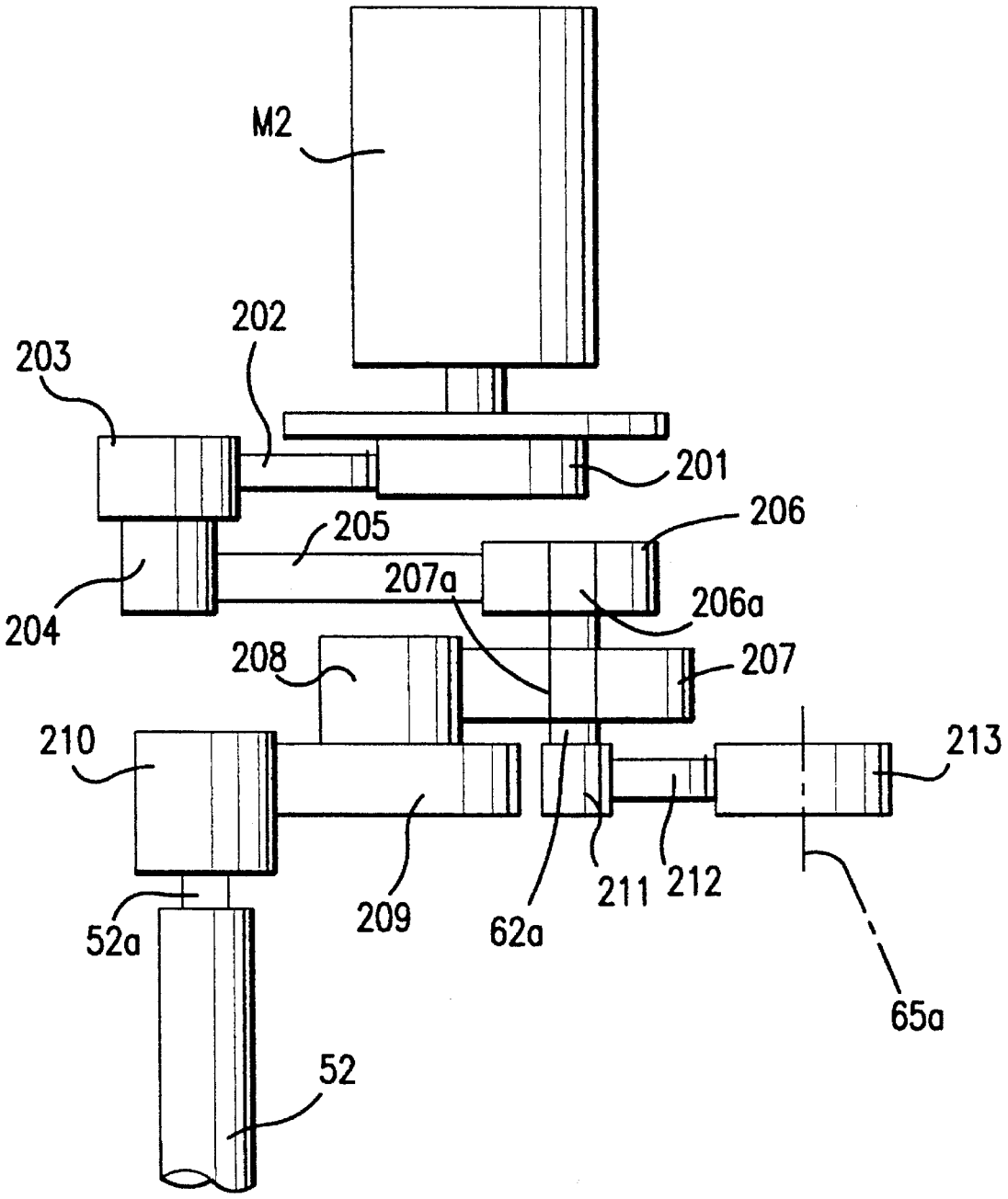
FIG. 6 is a flow chart for showing a driving system of second driving means.
Figure 7:
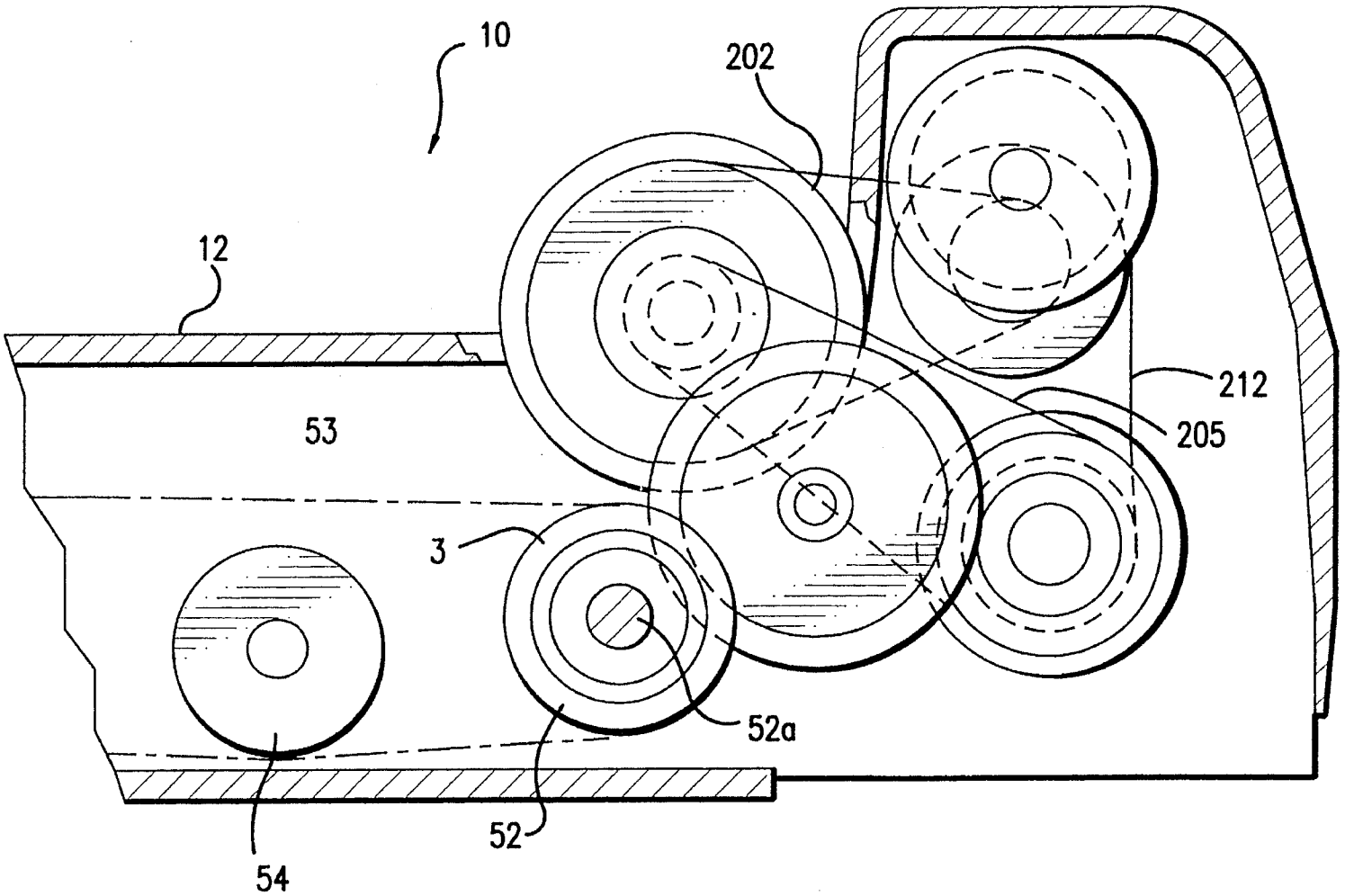
FIG. 7 is a side view of the driving system in the vicinity of a paper ejecting portion.

Next, a driving system of the first driving motor M1 is described based on FIGS. 4 and 5.

A driving pulley 101 of an output shaft of the first driving motor M1 actuates a following pulley 103 through a timing belt 102. A following pulley shaft 103*a* for the following pulley is provided with an electromagnetic brake 104, and is timely braked. A gear 105 is fixed to the following pulley shaft 103*a* in parallel, and the driving force is transmitted to a gear 107 through an intermediate gear 106. A one-way clutch (ow) 105*a* is securely mounted on the gear 105 and interrupts transmission of the driving force to the side of the transferring portion when the motor M1 rotates in a forward direction.

The gear 107 has a gear 108 provided on the same shaft, the gear 108 engages a gear 111 of the roller shaft 32*a* of the separating means 31 through the gears 109, 110, and the gear 109 houses the clutch ow 109*a* therein and interrupts transmission of the driving force to the separating means 31, the semicircular roller 23 and the feeding roller 30 when the motor M1 reverses. Further, the gear 109 is provided on a shaft with a pulley 112 located on the shaft 30*a* of the feeding roller 30, and the pulley 112 is coupled with a pulley 114 provided on the same shaft 22 as that of the semicircular roller 23 through the timing belt 113. A clutch ow 114*a* is securely mounted on the pulley 114.

On the other hand, a pulley 120 is firmly coupled with the following pulley shaft 103*a*, and driving force is transmitted to a pulley 122 through a timing belt 121. The pulley 122 is mounted on a belt roller shaft 51*a*, transmits driving force to the transferring portion 50 and, at the same time, is coupled with a gear 125 provided on the same shaft 40*a* as that of the register roller 40 through a gear 123 having the same shaft as that of the gear 122 and an intermediate gear 124. Incidentally, a clutch 126 which is timely detachable from the gear 125 is provided on the shaft 40*a*.

Incidentally, driving force of the first driving motor M1 is transmitted from the belt roller 51 to the belt roller 52 through the feeding belt 53, and from the belt roller 52 to a drawing-out roller 62 and a paper ejecting roller 65 of the ejecting portion 60. In other words, the first driving motor M1 is connected to actuate the paper feeding portion 20, the transferring portion 50 and the ejecting portion 60, which is described later.

Next, the construction of the ejecting portion 60 is explained with reference to FIG. 1 and FIGS. 4 through 8.

In the ejecting portion 60, there is provided a paper ejecting guide 61 extending from an exit of the transferring portion 50 with a large curve so that a document is reversed by about 180 degrees. And, along the paper ejecting roller 61 from the vicinity of the transferring portion 50, there are provided the drawing-out roller 62 firmly fixed to a shaft 62*a*, a pinch roller 63' and a paper ejecting sensor 63, and in the vicinity of an ejecting port 64, the paper ejecting roller 65 firmly coupled with a shaft 65*a* is provided.

Figure 8:
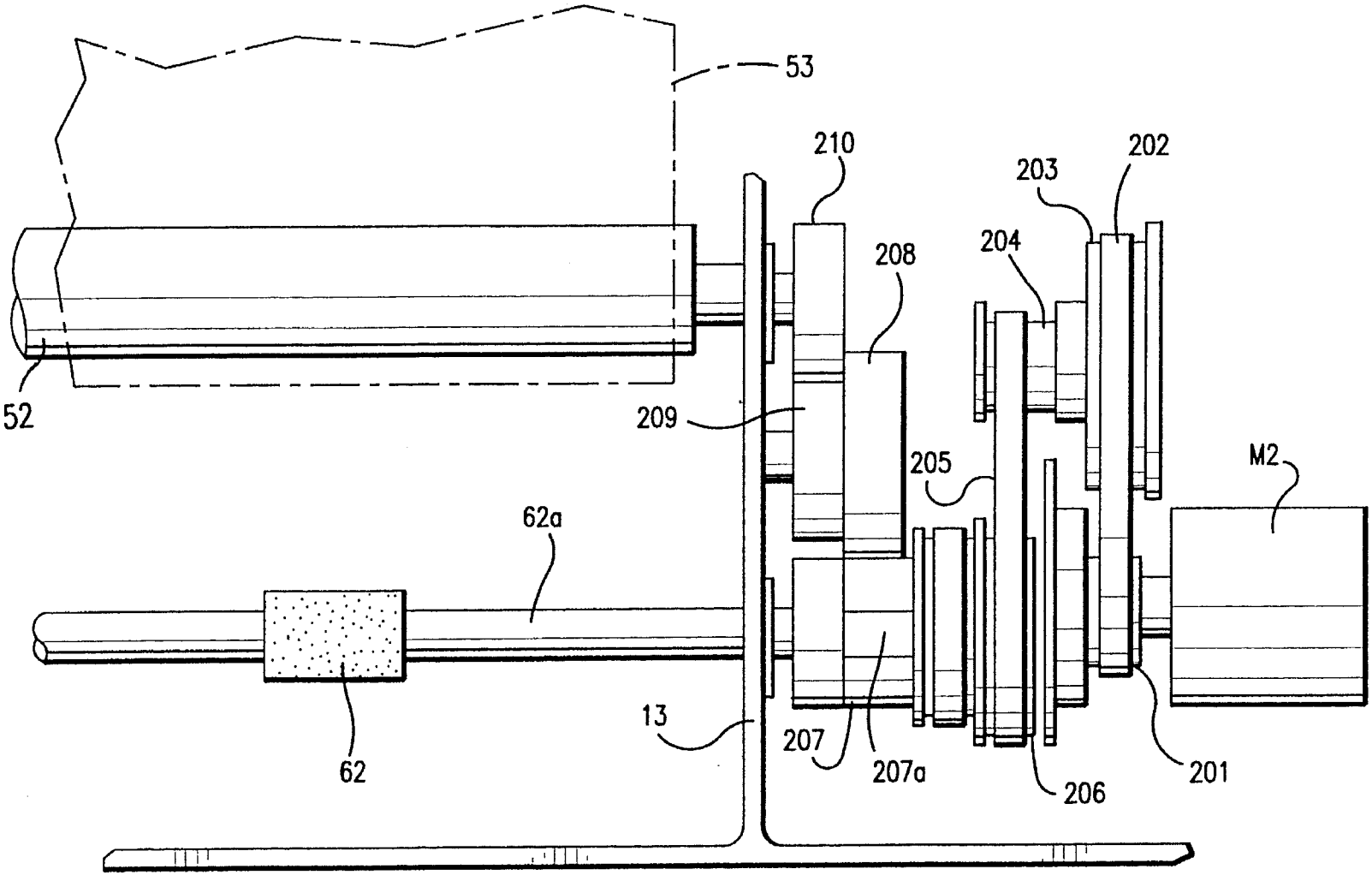
FIG. 8 is a plan view of the driving system in the vicinity of the paper ejecting portion.

A driving system of the second driving motor M2, as shown in FIG. 8, is organized such that a driving pulley 201 for an output shaft of the second driving motor M2 is connected to a following pulley 203 through a timing belt 202, a pulley 204 is provided on the same shaft as that of the following pulley 203, and a pulley 206 is connected to the pulley 204 through a timing belt 205. The pulley 206 is coupled with the shaft 62*a* for the drawing-out roller 62 through a one-way clutch (ow) 206*a*. The operation of the clutch ow 206*a* is described later. Further, a gear 207 is also coupled with the shaft 62*a* through a one-way clutch (ow) 207*a*. The clutch ow 207*a* constitutes connecting means for transmitting the driving force on the side of the transferring portion 50 to the ejecting portion 60 and, at the same time, for interrupting the driving force from the side of the ejecting portion 60, operation of which is described later.

The gear 207 engages a gear 208, and the gear 208 is firmly coupled with the same shaft as that of a gear 209 which engages a gear 210 firmly fixed to the shaft 52*a* of the transferring portion 50.

On the other hand, a pulley 211 as well as the gear 207 is firmly coupled with the shaft 62*a* for the drawing-out roller 62, and transmits force to a pulley 213 firmly coupled with the shaft 65*a* for the paper ejecting roller 65 through a timing belt 212.

Thus, as has been described, the driving force of the first driving motor M1 is transmitted to the paper ejecting portion 60 from the transferring portion 50, that is, transmitted to the pulleys 211 and 213 through the belt roller shaft 52*a* and gears 210–209–208–207. In this case, the clutch ow 207*a* is in a coupled state and transmits the driving force of the first driving motor M1, while the clutch ow 206*a* is in a released state to interrupt transmission of the driving force to the second driving motor M2.

And, on the contrary, when the second driving motor M2 is actuated, the clutch ow 206*a* is in a coupled state and transmits force to the shaft 62*a* to drive the drawing-out roller 62 and the paper ejecting roller 65 and, at the same time, the clutch ow 207*a* is released to prevent the driving force of the second driving motor M2 from being transmitted to the side of the transferring portion 50.

Next, a control apparatus, not shown, comprises a CPU, wherein a specific calculation is carried out in receipt of input signals from the empty sensor ETS, the register sensor 42 and the paper ejecting sensor 63, based on the calculated result and various commands from the main device C, the driving motors M1, M2, solenoids SOL1, SOL2 and the clutch 126 are timely controlled, and the controlled results are sent to the main device C. The operation of the controlling apparatus is described later with reference to a flow chart.

Figure 9:
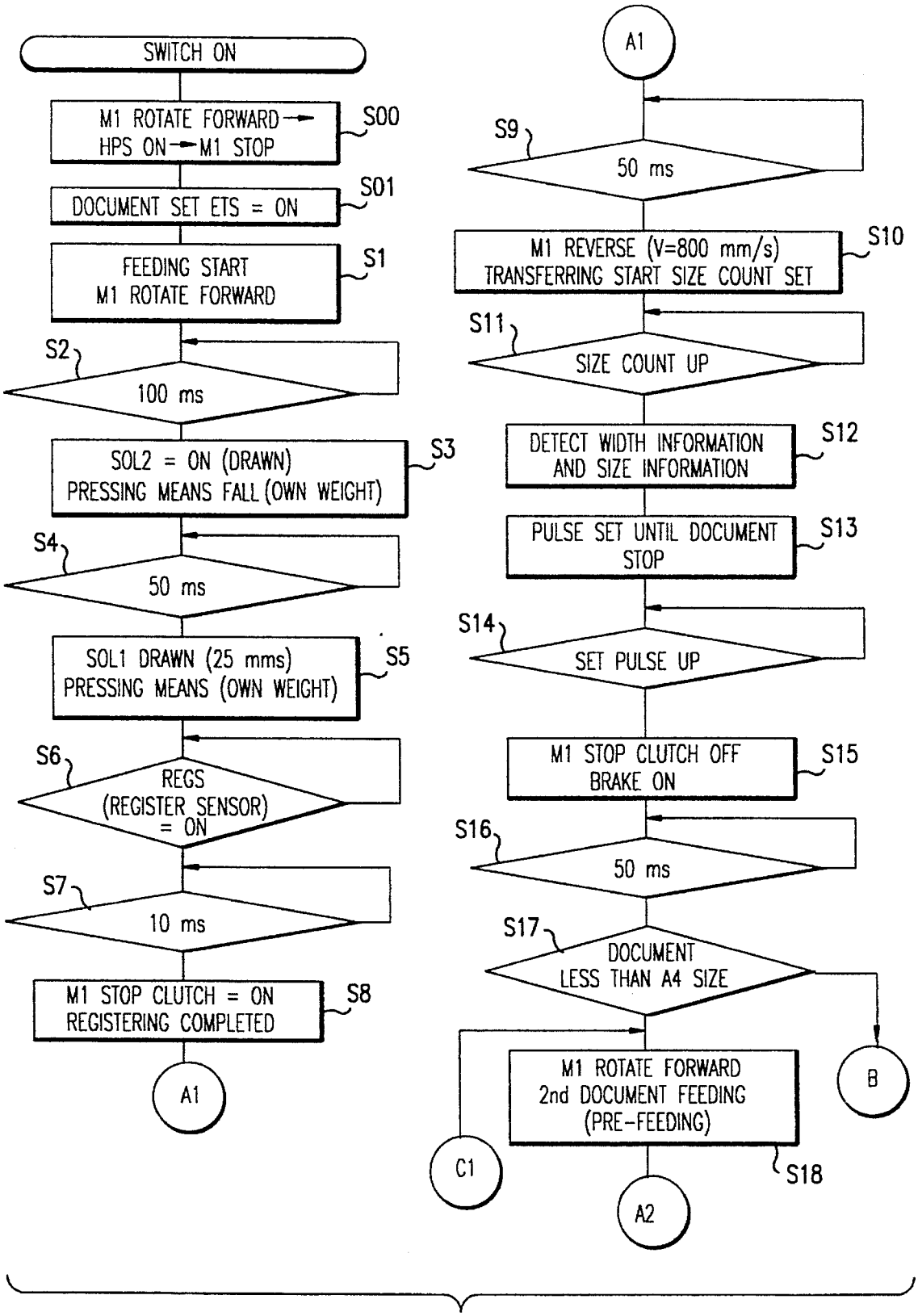
FIG. 9 is a flow chart of operation (part)
Figure 10:
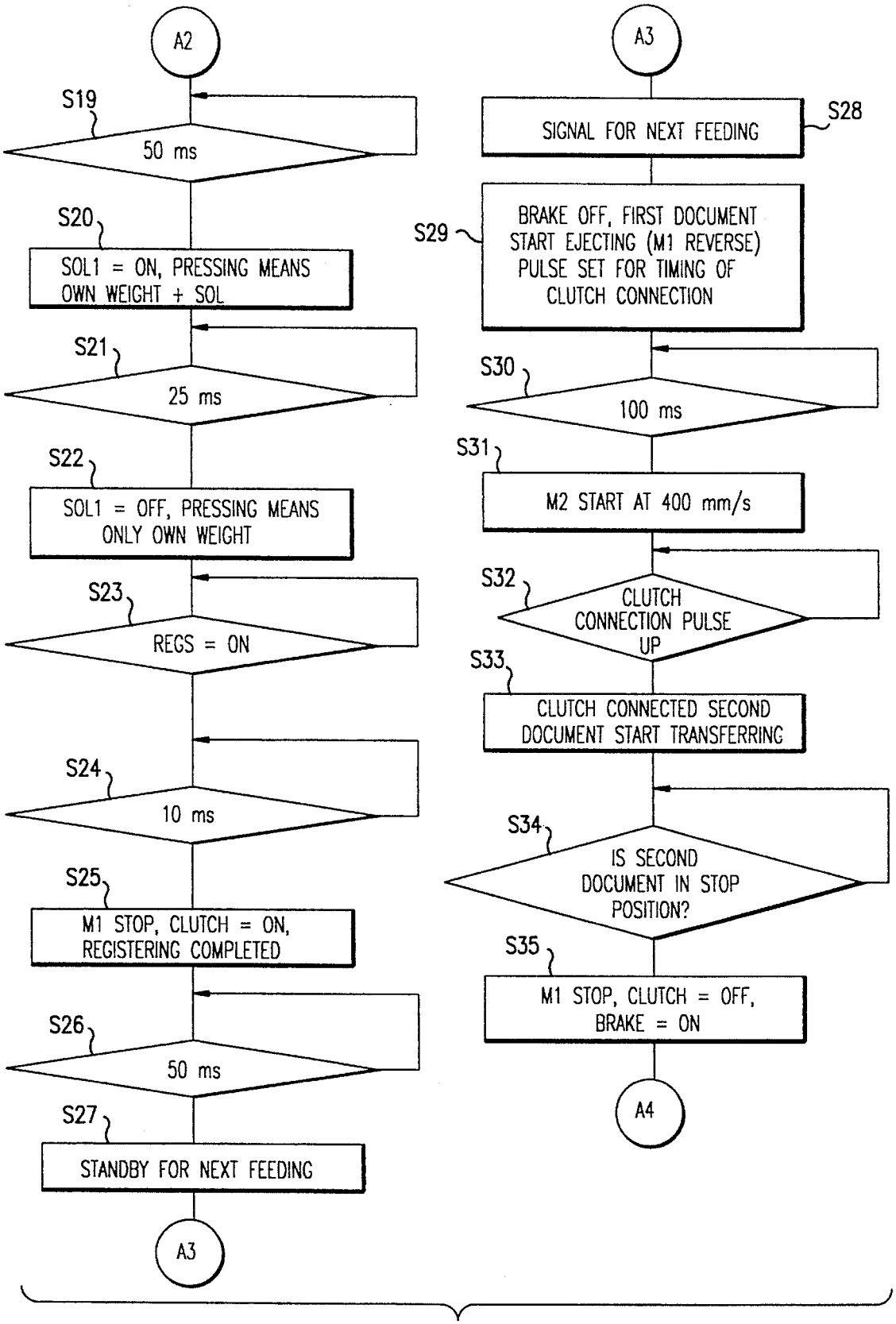
FIG. 10 is a flow chart of operation (part)
Figure 11:
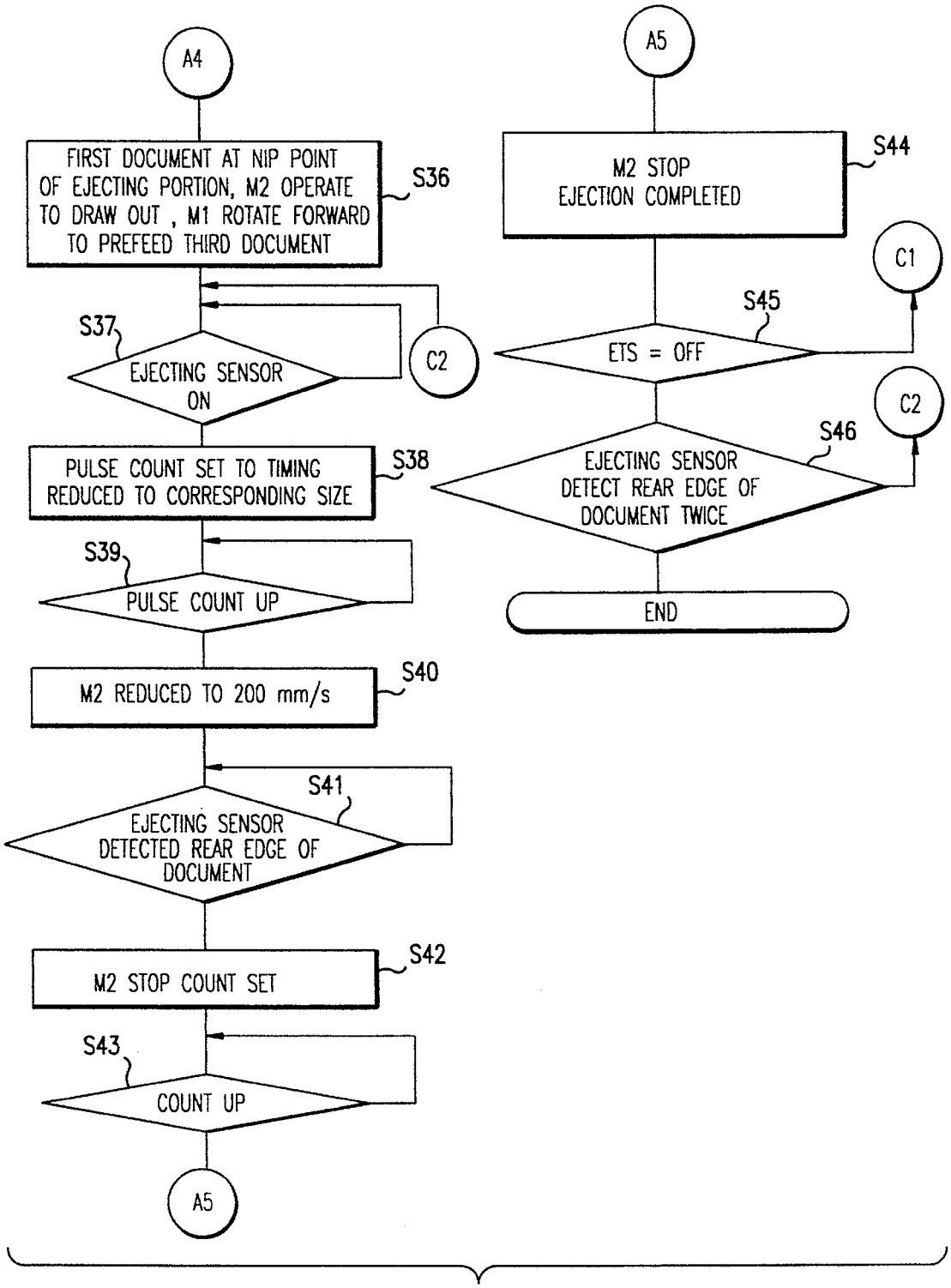
FIG. 11 is a flow chart of operation (part)
Figure 12:
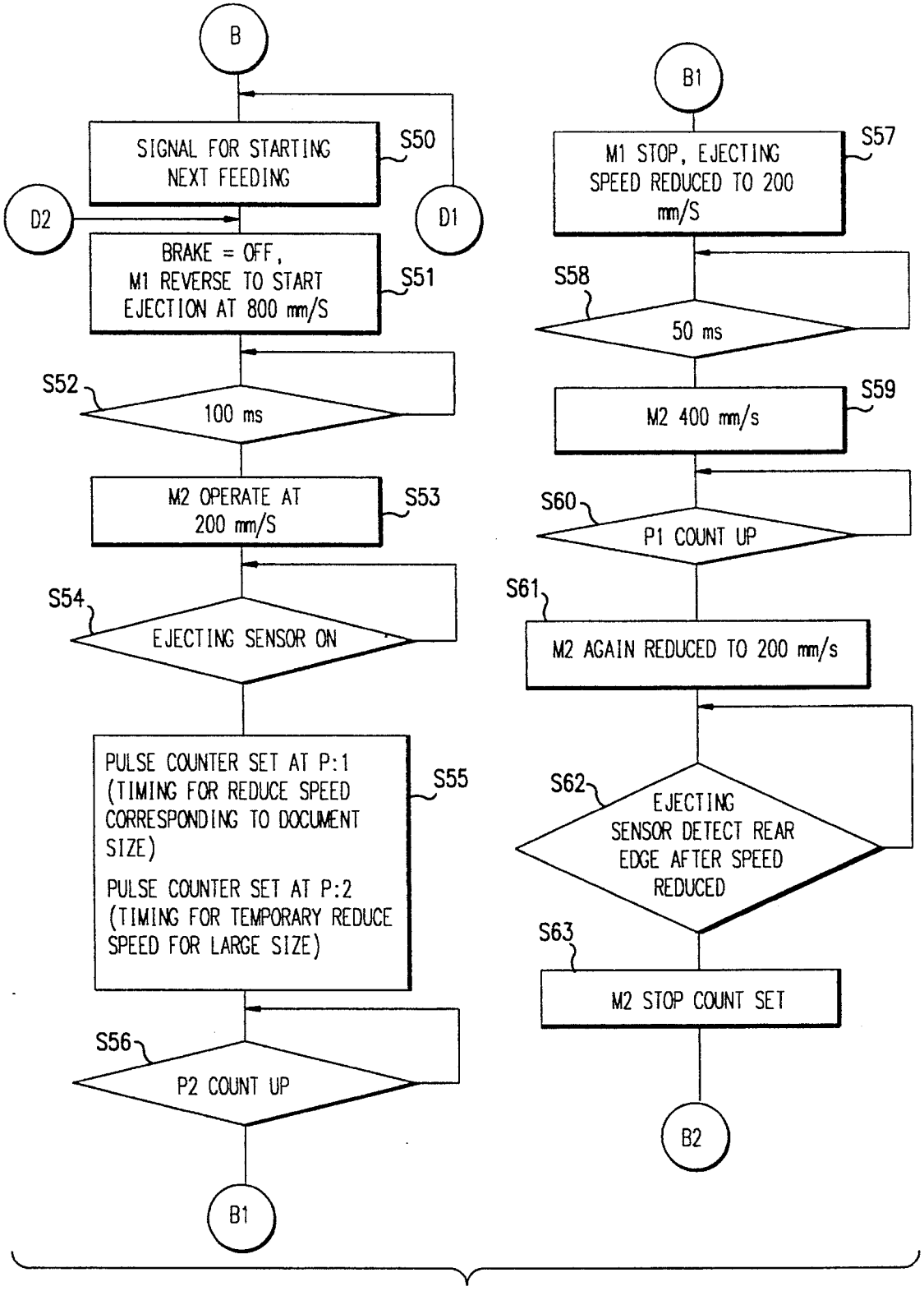
FIG. 12 is a flow chart of operation (part)
Figure 13:
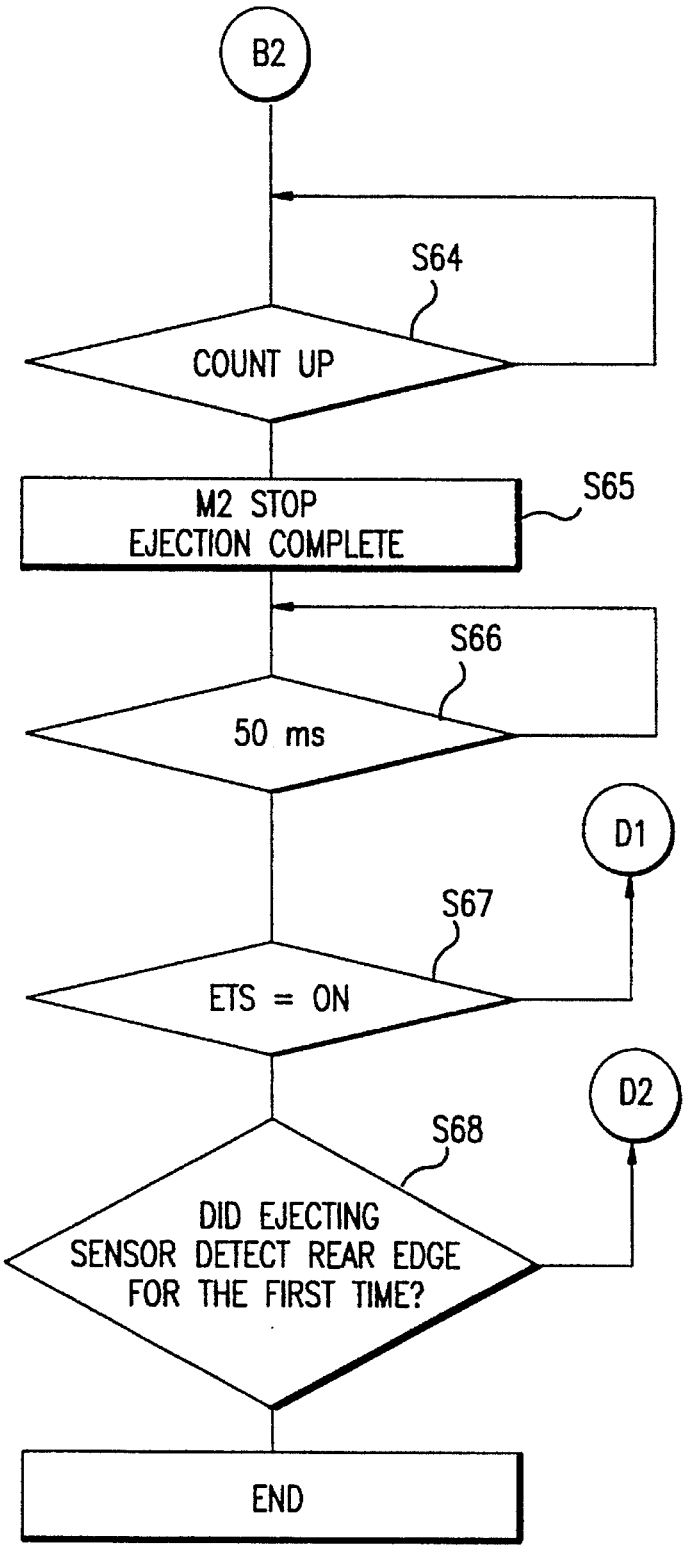
FIG. 13 is a flow chart of operation (part)
Figure 14A:
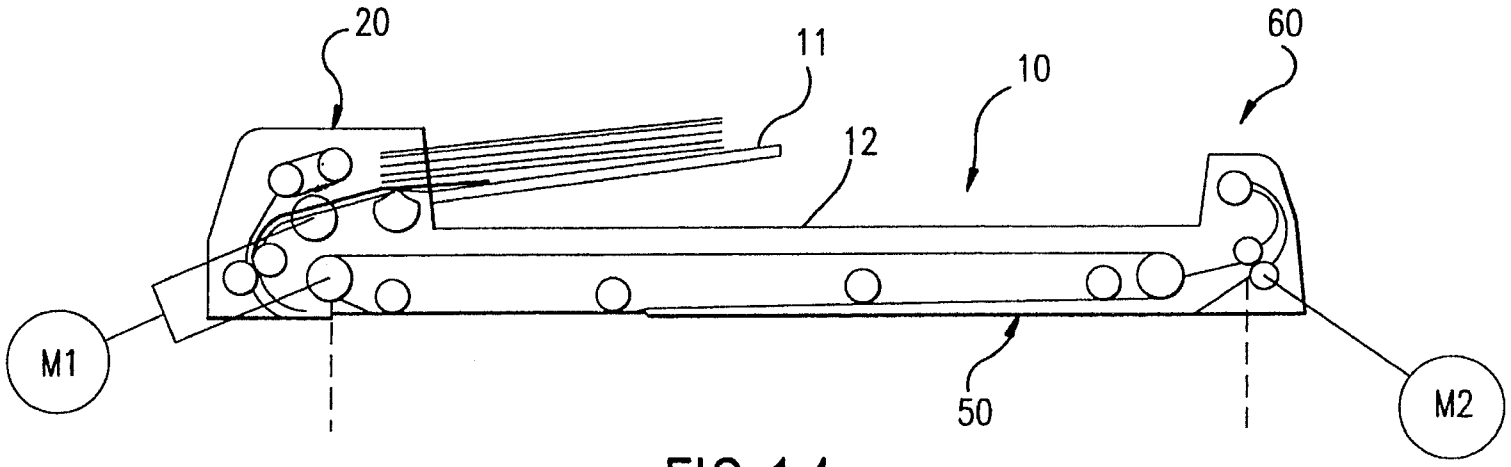
FIGS. 14(*a*)–14(*d*) are explanatory views of operation.
Figure 14B:
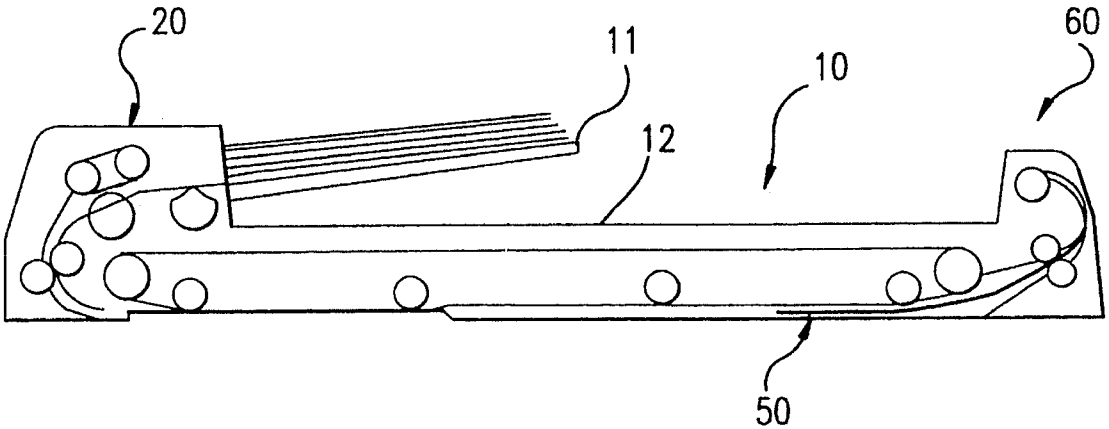
Figure 14C:
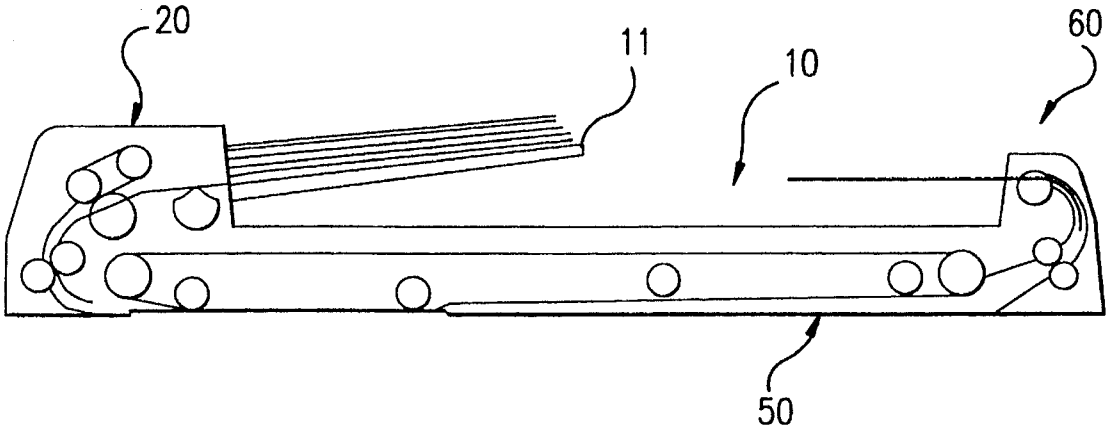
Figure 14D:
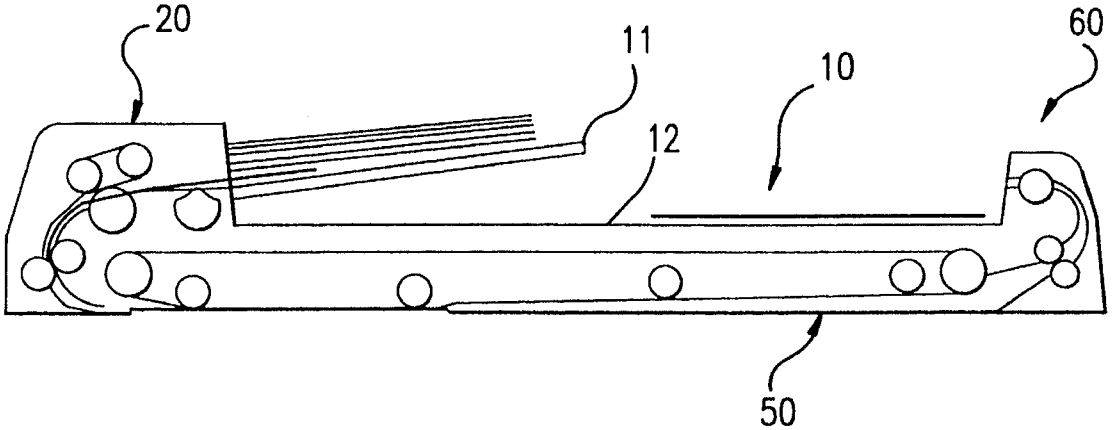

Next, movement of the apparatus 10 is described with reference to the above-mentioned drawings, flow charts of FIG. 9 and thereafter and operation drawings as shown in FIG. 14.

First, when power is on, the first driving motor M1 rotates in the forward direction, and the semicircular roller 23 rotates until it assumes the home position HPS where the notched portion 23*a* faces upward as shown in FIG. 2, and stops. At this time, an HPS sensor, not shown, detects the HPS (Step S00). Then, when documents are placed on the document tray 11, the empty sensor ETS is turned on and feeding preparation is completed (SO1).

At this point, when a paper feeding signal is received from the side of the main device C, a feeding operation starts and the motor M1 rotates. After about 100 ms, the solenoid SOL2 is magnetized. By this magnetic excitation, the lever 28, accordingly the stopper 25 are rotated in the counter-clockwise direction, and the document pressing means 35 which has been pushed upward by the claw portion 25*a* falls downward by its own weight, and lightly contacts the uppermost paper of the documents. Then, after 50 ms, the SOL1 is drawn for only 25 ms so that pressing force of the pressing means 35 against the documents is added (S1–S5). Thus, each document separated from the others by the feeding roller 30 and the separating belt 34 is positively fed one by one.

And, the motor M1 is stopped after 10 ms since the register sensor 42 (REGS) is turned on, and the clutch 126 is turned on, so that the register operation is completed (S6–S8).

After 50 ms of the completion of the register operation, the motor M1 reverses to start the transferring operation (linear velocity v=800 mm/s, the linear velocity which is described later is the first speed) and, at the same time, a size counter is set (S9, S10). When the size counter counts up, the document size information as well as width sensor information other than shown in the drawing are detected. And, based on the information, pulses until the document is stopped are set (S11–S13). When the motor M1 reverses, the belt roller 51 carries out transferring operation as can be seen from FIG. 5, and this driving is transmitted to the belt roller 52 and the drawing-out roller 62 as shown in FIG. 8. However, this driving force is not transmitted to the semicircular roller 23, the separating roller 32 and the feeding roller 30 by the function of the clutch ow 109*a*.

When the above pulses are counted up, the motor M1 stops, the clutch 126 is turned off, the brake 104 is turned on and the first document is positioned on a reference position P1 on the platen P as shown in FIG. 14(*a*), whereby the main device C carries out a copying operation (exposure) (S14, S15).

In the document feeding apparatus 10, after 50 ms of the step S15, in case a document to be fed is larger than an A4 or letter size, controllings after B (Step S50) are carried out, and only in case a document to be fed is smaller than the A4 or letter size, controllings after the next step S18 are carried out (S16, S17).

Then, in case a document is smaller than the A4 or letter size, in order to pre-feed a second sheet of a document (the second document), the motor M1 rotates (S18). Fifty ms later, the solenoid SOL1 is turned on whereby suction force of the solenoid 36 is applied to the pressing means 35 for only 25 ms (S19–S21). During this interval, the second document is taken out and, when the solenoid SOL1 is turned off, the second document is fed while being separated only with the own weight of the pressing means (S22).

Then, after 10 ms from a time when the register sensor REGS is turned on, the motor M1 is stopped and the clutch is turned on, whereby the register is completed (the second document pre-feeding) (Refer to FIG. 14(*a*)). Then, 50 ms later, the document feeding apparatus assumes a standby state ready for the next document. (S23–S27).

With a feeding signal (S28) of the next paper (the second document), the brake is turned off, the motor M1 is reversed, the first document begins to eject (at a linear velocity v=800 mm/s, the first speed) and, at the same time, a pulse counter is set for a connection timing of the clutch 126 to set intervals of the documents according to a timing of start of rotation of the register roller 40 (S29). Then, after 100 ms, the motor M2 starts operating at a linear velocity v of 400 mm/s, i.e., the second speed (S30, S31). On the other hand, in accordance with counting up of the pulse set at step S29, the clutch 126 is connected and the register roller 41 which has been released is connected to the motor M1 to thereby start feeding of the second document. Until this point, the preceding first document has been nipped by the drawing-out roller 62 in the ejecting portion 60, so that a predetermined interval between an rear edge of the first document and an leading edge of the second document, for example, 158 mm, is provided. (S32, S33).

And, when a stop position of the second document is confirmed (pulse counting up), the motor M1 stops, the clutch is turned off, and the brake 104 is turned on, so that the second document is positioned at the reference position P1 on the platen P and the main device C starts exposing (S34, S35) as shown in FIG. 14(*b*). During this time, the second driving motor M2 continuously performs the drawing-out operation and ejects the first document as shown in FIG. 14(*c*). On the other hand, at paper feeding side, a pre-feeding operation of a third document is carried out by the rotation of the motor M1 (S36) as shown in FIG. 14(*d*).

At a point when the paper ejecting sensor is turned on by the first document drawn out from the feeding portion 50, a pulse counter corresponding to a particular size is set, and at the counting up of the pulse, the feeding linear velocity v of the motor M2 is reduced to 200 mm/s. With this reduction, the leading edge of the document is prevented from being floated under the influence of the ejecting speed to hit against the rear surface of the document tray 11, to lose its order, or bend (S37–S40).

When the rear edge of the document is detected by the paper ejecting sensor 63, an M2 stop counter is set, and when counted up, the motor M2 is stopped, thus to complete ejecting operation of the first document (S41–S44). And, in case ETS is on, operations after step S18 are repeated (S45).

At step S45, in case ETS is off, operations after step S37 are repeated until the paper ejecting sensor 63 completes further two times of operation so that complete ejection of the document present in a path is confirmed and the paper transferring operation terminates (S46).

On the other hand, at step S17, when a document is determined to be of a size larger than an A4 or letter size, i.e. a large size, operations after step S50 are carried out.

More specifically, with a start signal of the next paper feeding, the brake 104 is turned off, and with the reverse rotation of the motor M1, the paper ejecting operation is carried out at a linear velocity v of 800 mm/s (the first speed) for 100 ms (S50–S52). In this section, the connecting means ow 207*a* is in a connecting state, and the feeding portion 50 and the ejecting portion 60 are driven at the same speed so that excessive force is not applied to the document. And, after 100 ms, the motor M2 is rotated at a velocity v of 200 mm/s (the second speed) (S53).

When the paper ejecting sensor 63 is turned on, pulse p1 for a speed reduction timing corresponding to a size of the document and pulse p2 for a temporary speed reduction timing for a large sized document to turn the leading edge downward, start to be counted (S54, S55).

When the pulse p2 is counted up, the motor M1 stops, and the paper ejecting speed of the motor M2 is reduced to 200 mm/s. And, 50 ms later, the motor M2 is driven at an increased speed of 400 mm/s. Further, when the pulse p1 is counted up, the motor M2 is again reduced to a velocity of 200 mm/s (S56–S61). As described above, with timely adjustment of the ejecting speed, a document is prevented from floating up and running on the document tray 11, or colliding with the tray 11 to lose its order.

When the paper ejecting sensor 63 detects a rear edge of the document, a counter for stopping the motor M2 is set, and when counted up, the motor M2 stops to complete the paper ejecting operation (S62–S65).

And, after 50 ms, in case ETS is turned on, the operation proceeds to step S50, or in case ETS is turned off, detection of the rear edge of the document thereafter is counted by the paper ejecting sensor 63, wherein if one detection is not completed, the operation proceeds to step S51, and if one detection is completed the paper feeding operation is completed since ejection of the document in the path is confirmed (S66–S68).

Figure 15:
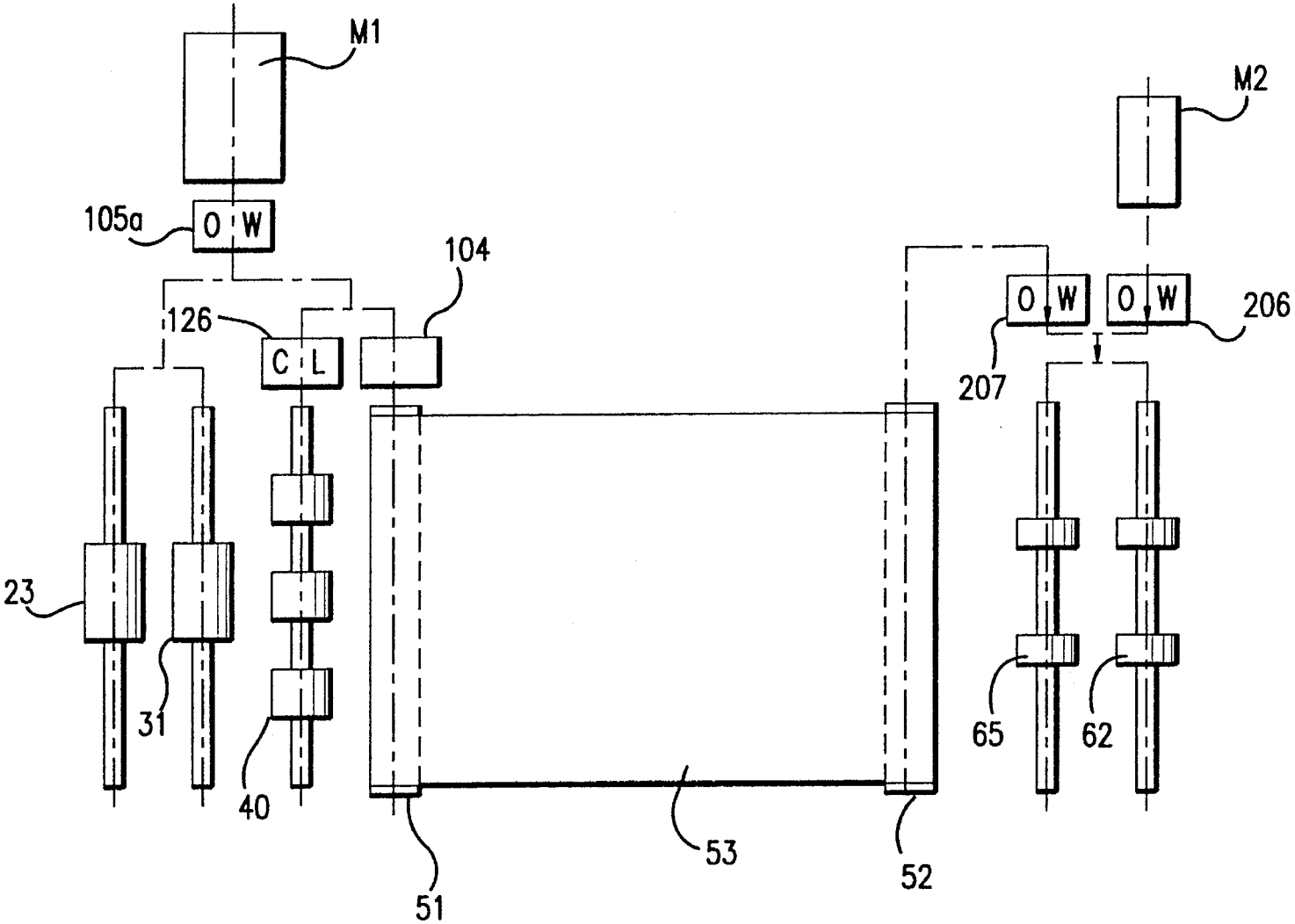
FIGS. 15 and 16 are explanatory views of the driving system of the present application.
Figure 16:
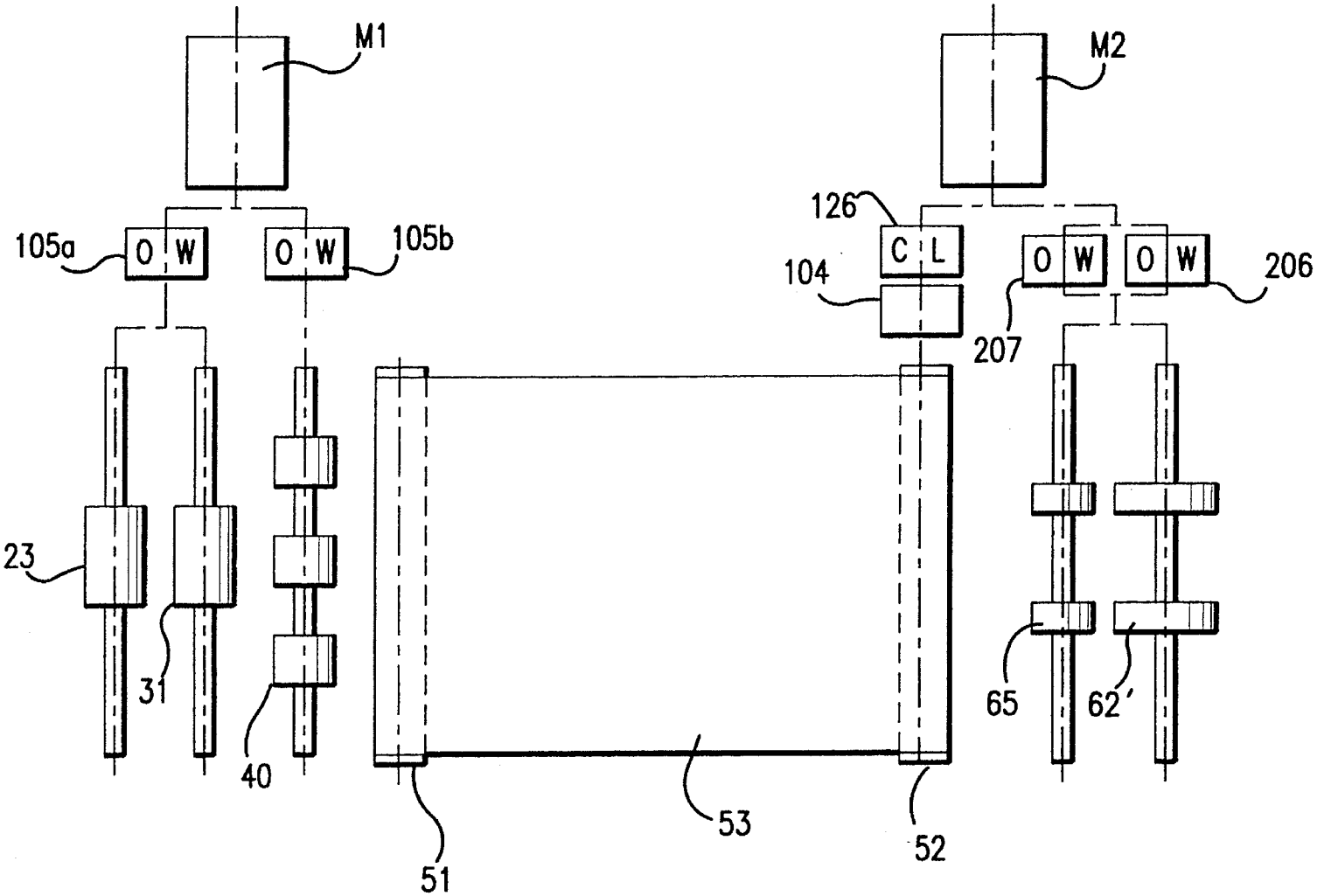

FIGS. 15 and 16 conceptionally show driving systems of the present invention.

FIG. 15 corresponds to the embodiment described hereinabove and the description for its operation is omitted.

FIG. 16 shows a driving system of another embodiment wherein the present invention is applied to a document feeding apparatus provided with a two side copying function, and in comparison with FIG. 15, the same reference numerals show the same members. Further, the differences from the embodiment shown in FIG. 15 reside in that, first, driving of the feeding belt 53 is shifted from the first driving motor M1 to the second driving motor M2 and, at the same time, positions of the clutch 126 and electromagnetic brake 104 used on the paper feeding side are changed to positions between the feeding belt 53 and the second driving motor M2 so that transmission of rotation driving of the second driving motor M2 is timely interrupted by the clutch 126 which, in the document feeding operation, corresponds to the one-way clutches 206, 207 in the above embodiment as shown in FIG. 15. Further, with the above position change, a new one-way clutch 105*b* is provided between the register roller 40 and the first driving motor M1 and, at the same time, the drawing-out roller 62 is replaced with a drawing-out roller 62' having a diameter with which a document can be reversed, in order to again return a document to be ejected on the platen P of the main device C by reverse driving of the second driving motor M2. Therefore, although the function in a basic paper ejecting operation is the same as that of the above embodiment, in this embodiment, as described before, the document to be ejected is again returned onto the platen P of the main device C so as to transfer the document in a reversed state to be subjected to two side copying.

Incidentally, the electromagnetic brake 104 is to interrupt movement of the feeding belt 53 when the document is drawn out from the feeding belt 53 subsequent to termination of the feeding belt 53 when the treated document is ejected, so that the next document positioned on a specific position on the platen P by the feeding belt 53 is not deviated from the specific position.

According to the document feeding apparatus of the present invention, a document feeding apparatus including transferring means and ejecting means for ejecting documents to a paper ejecting tray comprises first driving means connected to both the means to drive at a first speed; second driving means connected to the ejecting means to drive at a second speed; connecting means for preventing driving of the second driving means from being transmitted to the transferring means and, at the same time, allowing driving of the first driving means to be transmitted to the ejecting means; and control means for controlling to eject a document by terminating the first driving means after the document is transferred from the transferring means to the ejecting means by the first driving means and ejecting the document to a paper ejecting tray by the second driving means, so that although driving means are provided on both sides of the transferring means and the ejecting means, linear velocities of both the means can easily and completely coincide with each other, and there is no risk of damaging the document such as a bend. Further, in order to prevent the document from being bent, it is not required that the driving means on the side of paper ejecting means is formed larger to have the linear velocity on the side of the ejecting mean equal to or higher than that of the transferring means, to thereby provide a cheap and small-sized document feeding apparatus.

I claim:

1. A document feeding apparatus comprising:

a document supplying tray for receiving and supplying documents thereon;

transferring means for feeding the documents on the document supplying tray, in order, to a predetermined position at specific intervals and, after being stopped once, said transferring means starting again to transfer the documents from said position in order;

a feeding portion located between the document tray and the transferring means, said feeding portion picking up one document from the document supplying tray and feeding to the transferring means;

ejecting means for ejecting the documents transferred by said transferring means from said predetermined position to a paper ejecting tray;

one driving means drivingly connected to said transferring and ejecting means and driving both said means;

additional driving means for actuating the feeding portion;

connecting means situated between the transferring means and the driving means for driving said transferring means by the driving means, said connecting means terminating connection between said transferring and driving means so that when said transferring means is once stopped, said ejecting means is continuously driven by the driving means; and control means for controlling to interrupt driving force from the driving means to said transferring means by said connecting means after the document is transferred from the transferring means to the ejecting means driven by the driving means, and to allow continuous driving of the ejecting means by the driving means so that the document is ejected onto the paper ejecting tray.

2. A document feeding apparatus according to claim 1, wherein said connecting means is a clutch connected to the driving means.

3. A document feeding apparatus according to claim 1, further comprising at least one one-way clutch situated between the ejecting means and the connecting means, said driving means being connected to the connecting means and the at least one one-way clutch.

4. A document feeding apparatus comprising:

transferring means for feeding documents, in order, to a predetermined position at specific intervals and, after being stopped once, said transferring means starting again to transfer the documents from said position in order;

ejecting means for ejecting the documents transferred by said transferring means from said predetermined position to a paper ejecting tray;

one driving means drivingly connected to said transferring and ejecting means and driving both said means;

a clutch situated between the transferring means and the driving means for driving said transferring means, said clutch terminating connection between said transferring and driving means so that when said transferring means is once stopped, said ejecting means is continuously driven by the driving means; and control means for controlling to interrupt driving force from the driving means to said transferring means by said clutch after one of said documents is transferred from the transferring means to the ejecting means driven by the driving means, and to allow continuous driving of the ejecting means by the driving means so that said one document is ejected onto the paper ejecting tray.

5. A document feeding apparatus according to claim 4, further comprising at least one one-way clutch situated between the ejecting means and the driving means, said driving means being connected to the clutch and the at least one one-way clutch.

* * * * *